US009630288B2

(12) United States Patent
Lin et al.

(10) Patent No.: US 9,630,288 B2
(45) Date of Patent: Apr. 25, 2017

(54) GRINDER

(71) Applicants: Chi-Wen Lin, Taichung (TW); Chi-Kuo Lin, Taichung (TW)

(72) Inventors: Chi-Wen Lin, Taichung (TW); Chi-Kuo Lin, Taichung (TW)

( * ) Notice: Subject to any disclaimer, the term of this patent is extended or adjusted under 35 U.S.C. 154(b) by 43 days.

(21) Appl. No.: 14/872,650

(22) Filed: Oct. 1, 2015

(65) Prior Publication Data

US 2016/0023317 A1 Jan. 28, 2016

(51) Int. Cl.
*B24B 3/26* (2006.01)
*B24B 5/04* (2006.01)

(52) U.S. Cl.
CPC ..... *B24B 5/04* (2013.01)

(58) Field of Classification Search
CPC ..... B24B 3/26; B24B 5/04; B24B 7/00
USPC ... 451/48, 178–179, 182, 375–376, 212–215
See application file for complete search history.

(56) References Cited

U.S. PATENT DOCUMENTS 819,173 A * 5/1906 Schmaltz ..... B24B 3/045 451/274
3,851,424 A * 12/1974 Kawaragi ..... B24C 3/26 451/291
5,400,546 A * 3/1995 Christian ..... B24B 3/32 451/138
6,652,367 B1 * 11/2003 Lin ..... B24B 3/24 451/178
6,676,494 B1 * 1/2004 Ching ..... B24B 3/247 451/231
7,172,498 B2 * 2/2007 Bernard ..... B24B 3/26 451/231
7,473,163 B1 * 1/2009 Lee ..... B24B 3/02 451/231
7,488,238 B2 * 2/2009 Liao ..... B24B 3/26 451/234
7,641,202 B1 * 1/2010 Dovel ..... B23B 31/1215 269/233

* cited by examiner

*Primary Examiner* — Robert Rose

(57) ABSTRACT

A grinding machine of one embodiment includes an abrasive wheel; a rectangular base including a top wall having a central through hole and an upper shoulder; a mounting member secured to the central through hole; an electric motor including a drive shaft passing through the mounting member to secure to the abrasive wheel; first and third workpiece holding units each including a board secured to the base; an adjustment knob on the board; and an L-shaped seat secured to the board and having a transverse channel, a front curved slot, a rear projection pivotably secured to the board, and a pin secured to the board and disposed in the slot; a second workpiece holding unit secured to the shoulder and including a vertical tunnel; and a fourth workpiece holding unit secured to the shoulder and including a vertical tunnel, an adjustment knob, and a fastening member.

1 Claim, 9 Drawing Sheets

GRINDER

BACKGROUND OF THE INVENTION

1. Field of the Invention

The invention relates to grinding machines and more particularly to a modular grinding machine.

2. Description of Related Art

A conventional grinding machine comprises a machine bed, at least one grinding spindle, two opposite grinding wheel holders each having at least one grinding wheel and longitudinal axes of the grinding wheel oriented parallel to each other, and two opposite work holding devices each having a work headstock and a steady rest and longitudinal axes of the work holding devices oriented parallel to each other. Each work headstock and the associated steady rest are configured to arrange therebetween a separate work fixture having workpieces to be ground.

While the device enjoys its success in the market, continuing improvements in the exploitation of grinding machine are constantly sought.

SUMMARY OF THE INVENTION

It is therefore one object of the invention to provide a grinding machine comprising an abrasive wheel; a rectangular base including a wall fastened on a top, the wall having a central through hole and an upper shoulder; a mounting member secured to the central through hole; an electric motor including a drive shaft passing through the mounting member to secure to the abrasive wheel; first and third workpiece holding units each including a board secured to the base; an adjustment knob disposed on the board; and an L-shaped seat secured to the board and having a transverse channel, a front curved slot, a rear projection pivotably secured to the board, and a pin secured to the board and disposed in the slot; a second workpiece holding unit secured to the shoulder and including a vertical tunnel; a fourth workpiece holding unit secured to the shoulder and including a vertical tunnel, an adjustment knob, and a fastening member; a cover placed on the electric motor and secured to the base; a positioning device including a vertical channel and a seat secured to one side of the cover; a holding device secured to the other side of the cover and including at least one shelf, a plurality of holes through the at least one shelf, and a hinged cover; and a power source disposed on the base adjacent to the electric motor, the power source being electrically connected to the motor.

The above and other objects, features and advantages of the invention will become apparent from the following detailed description taken with the accompanying drawings.

DETAILED DESCRIPTION OF THE INVENTION

Figure 1:
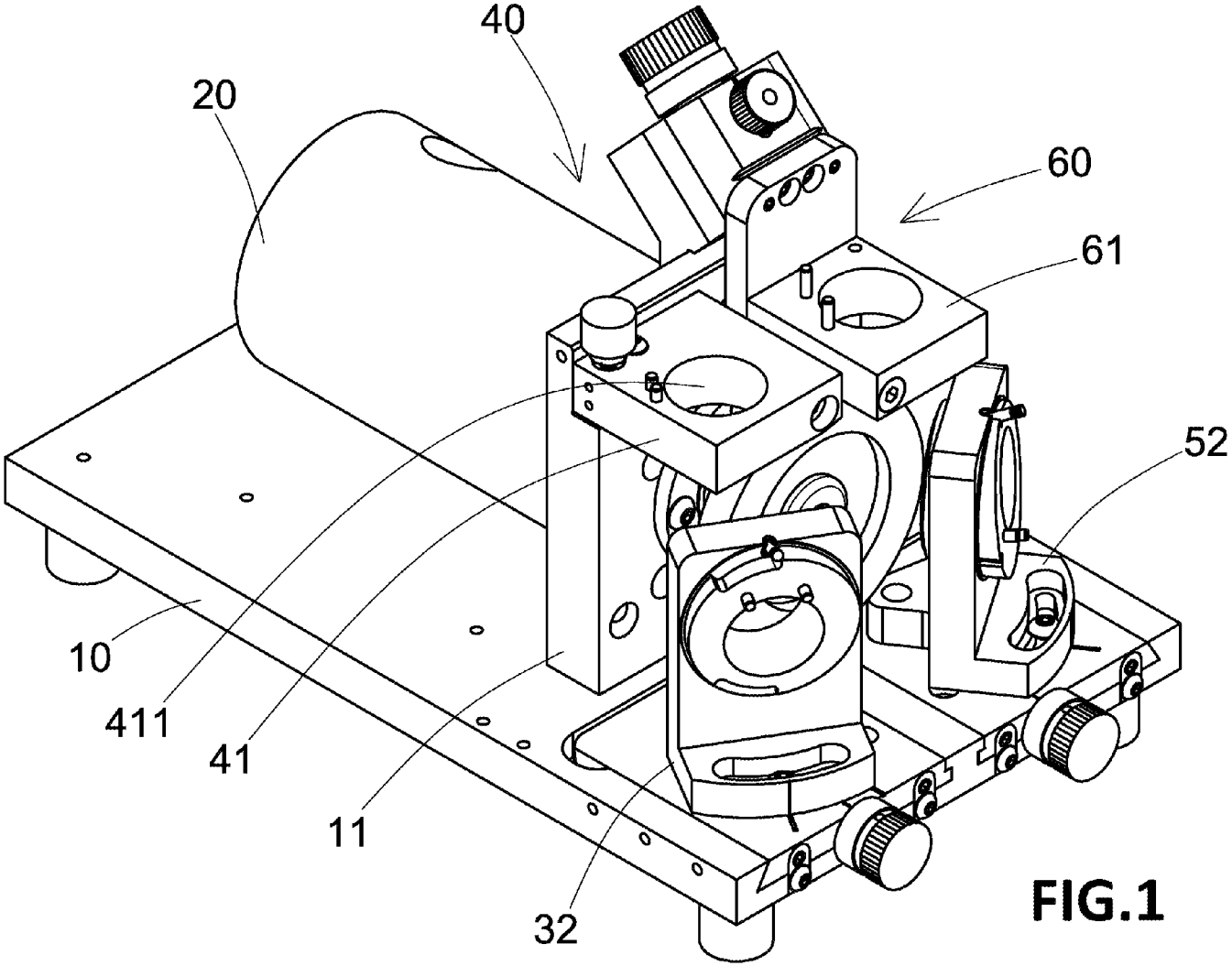
FIG. 1 is a perspective view of a grinding machine according to a first preferred embodiment of the invention.
Figure 2:
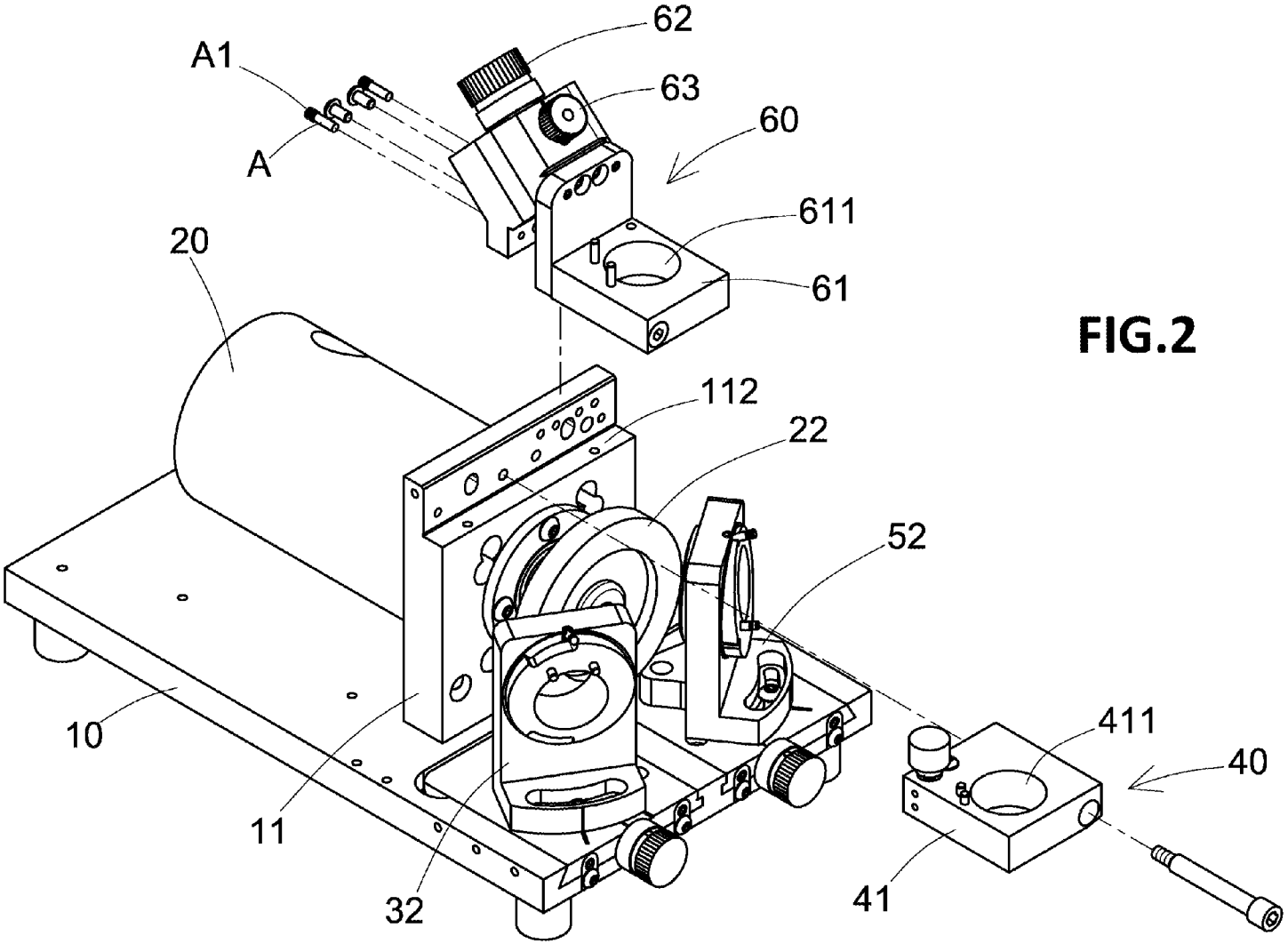
FIG. 2 is an exploded view of FIG. 1.
Figure 3:
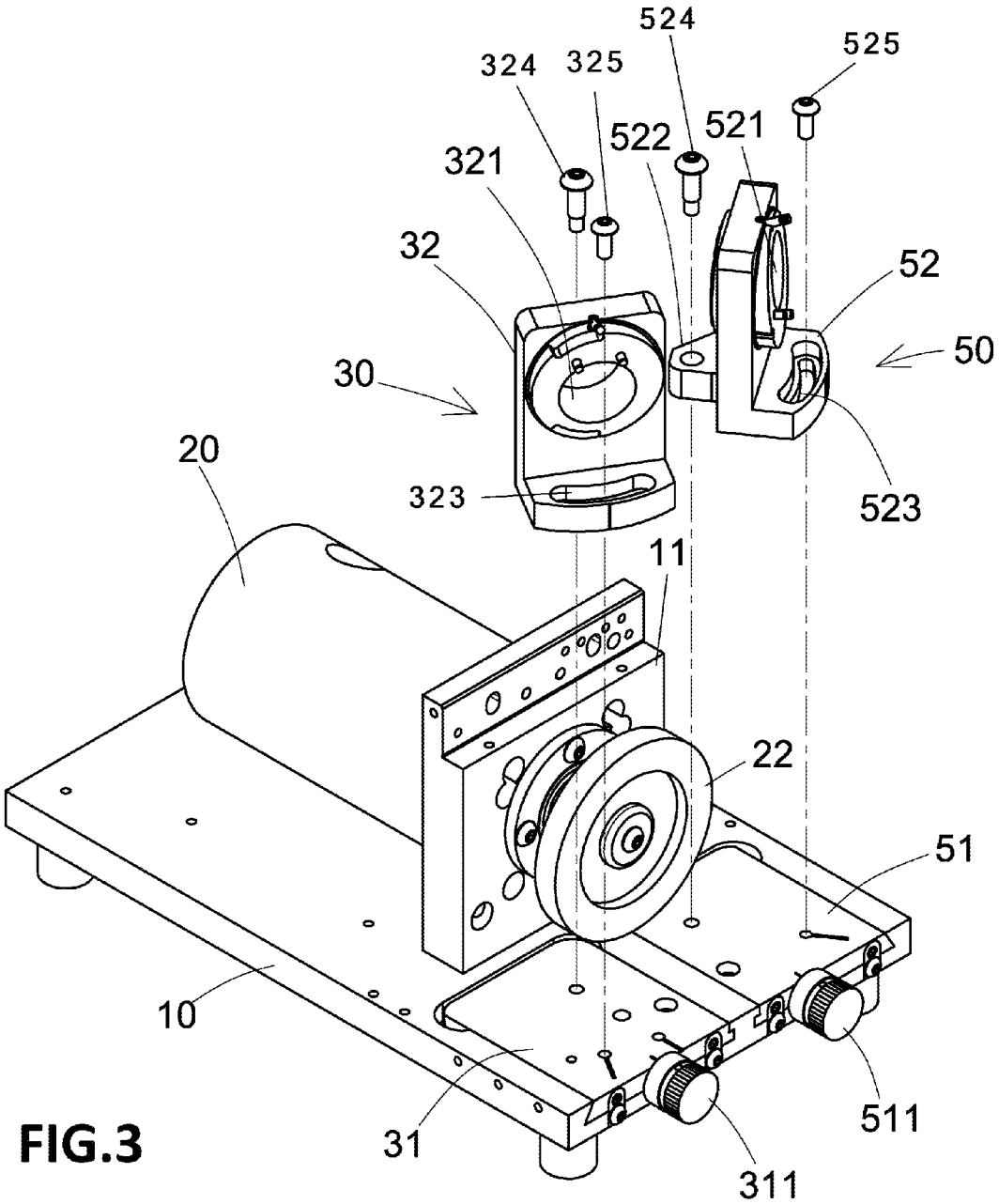
FIG. 3 is a further exploded view of FIG. 2 with second and fourth workpiece holding units removed.
Figure 4:
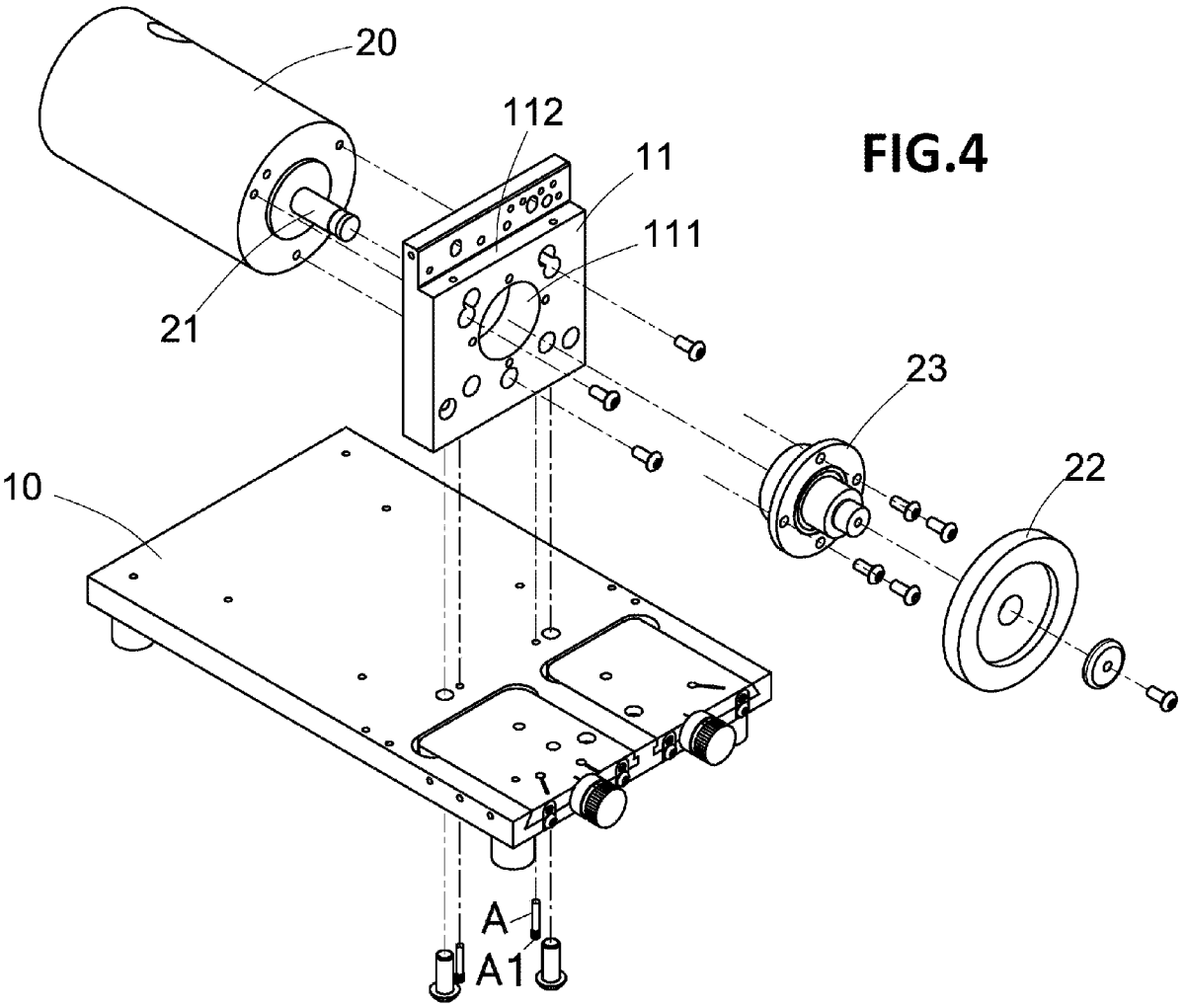
FIG. 4 is a further exploded view of FIG. 3 with first and third workpiece holding units removed.
Figure 5:
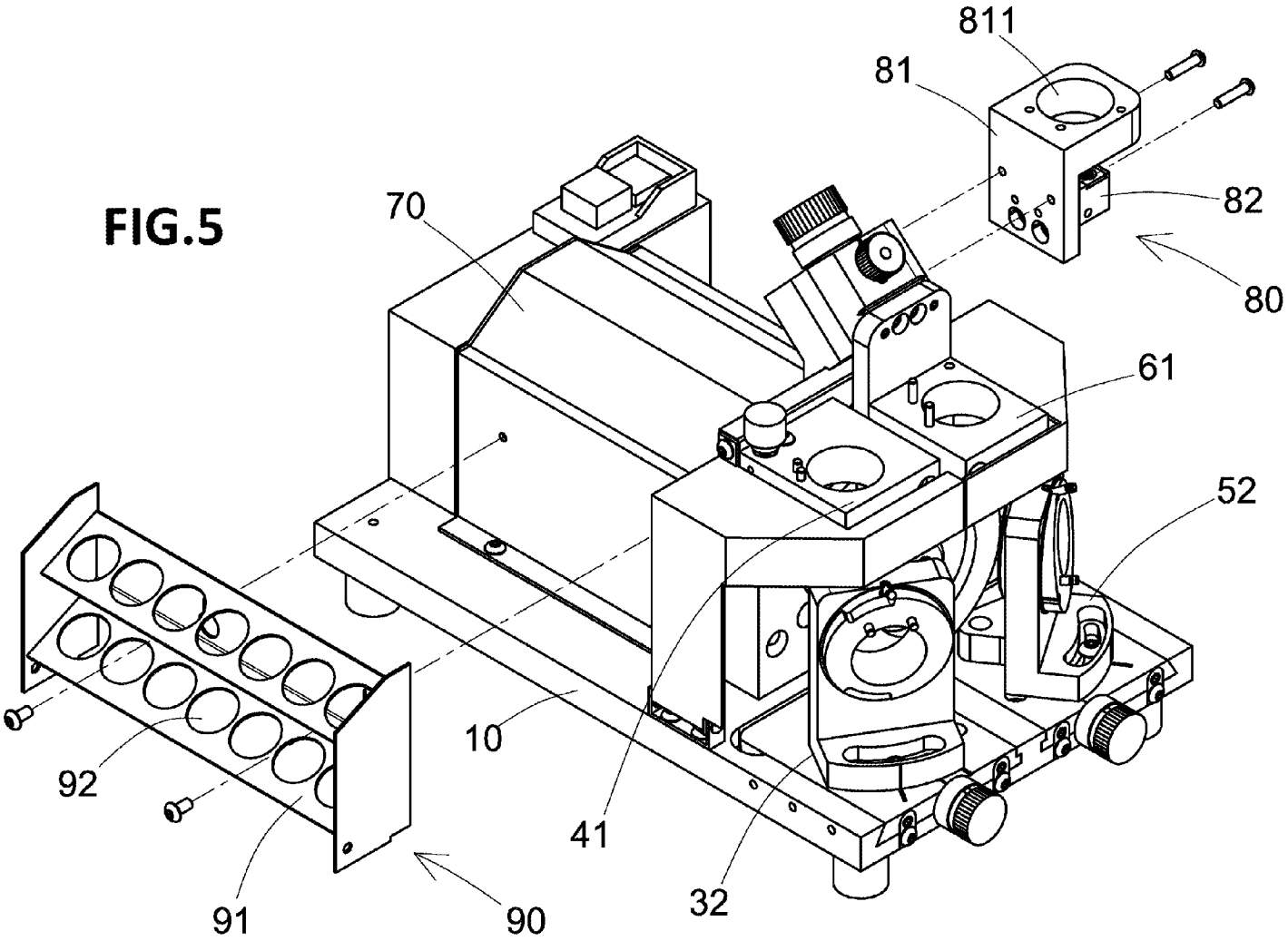
FIG. 5 is an exploded view of grinding machine according to a second preferred embodiment of the invention.
Figure 6:
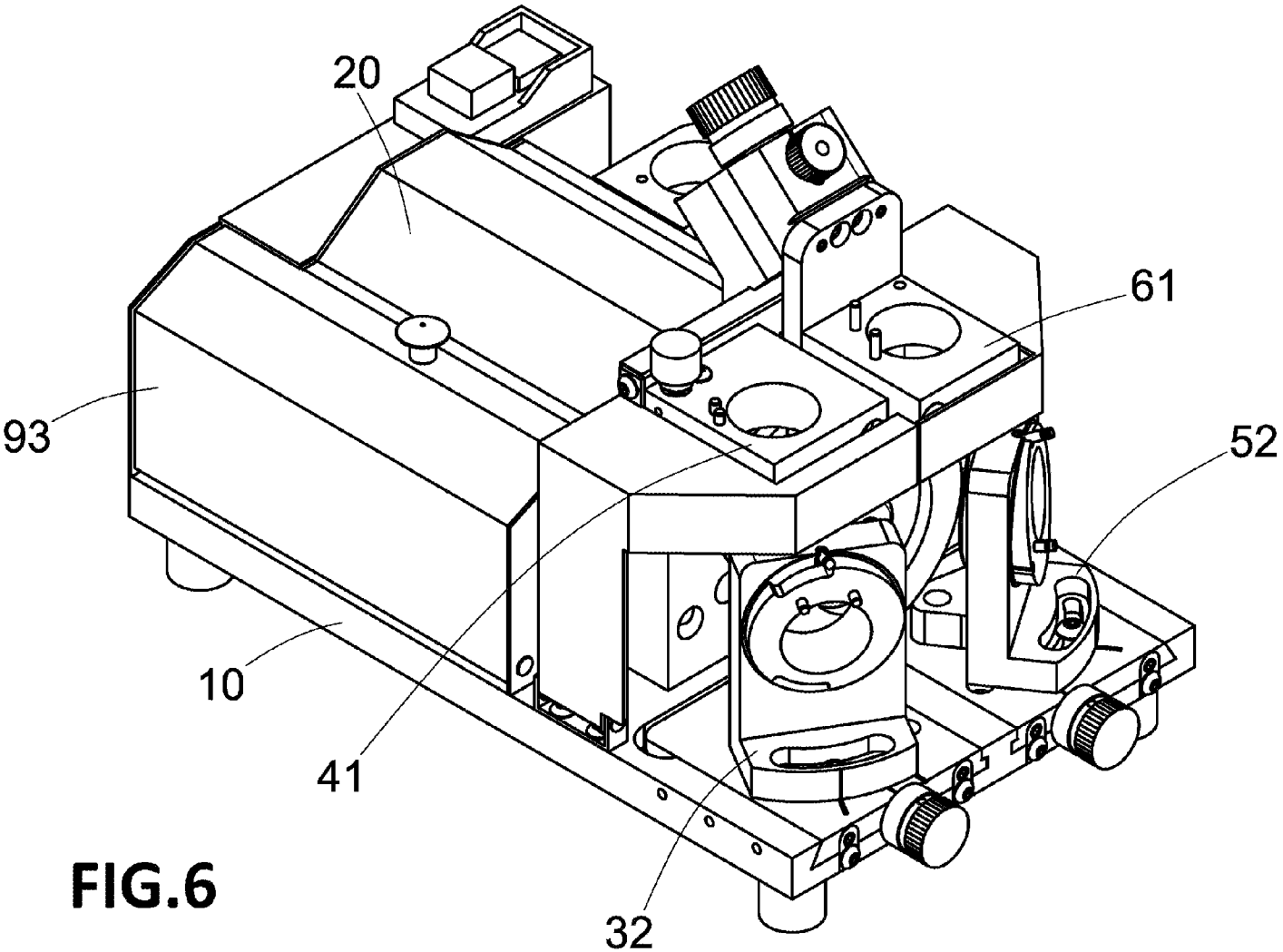
FIG. 6 is a perspective view of the assembled grinding machine of FIG. 5.
Figure 7:
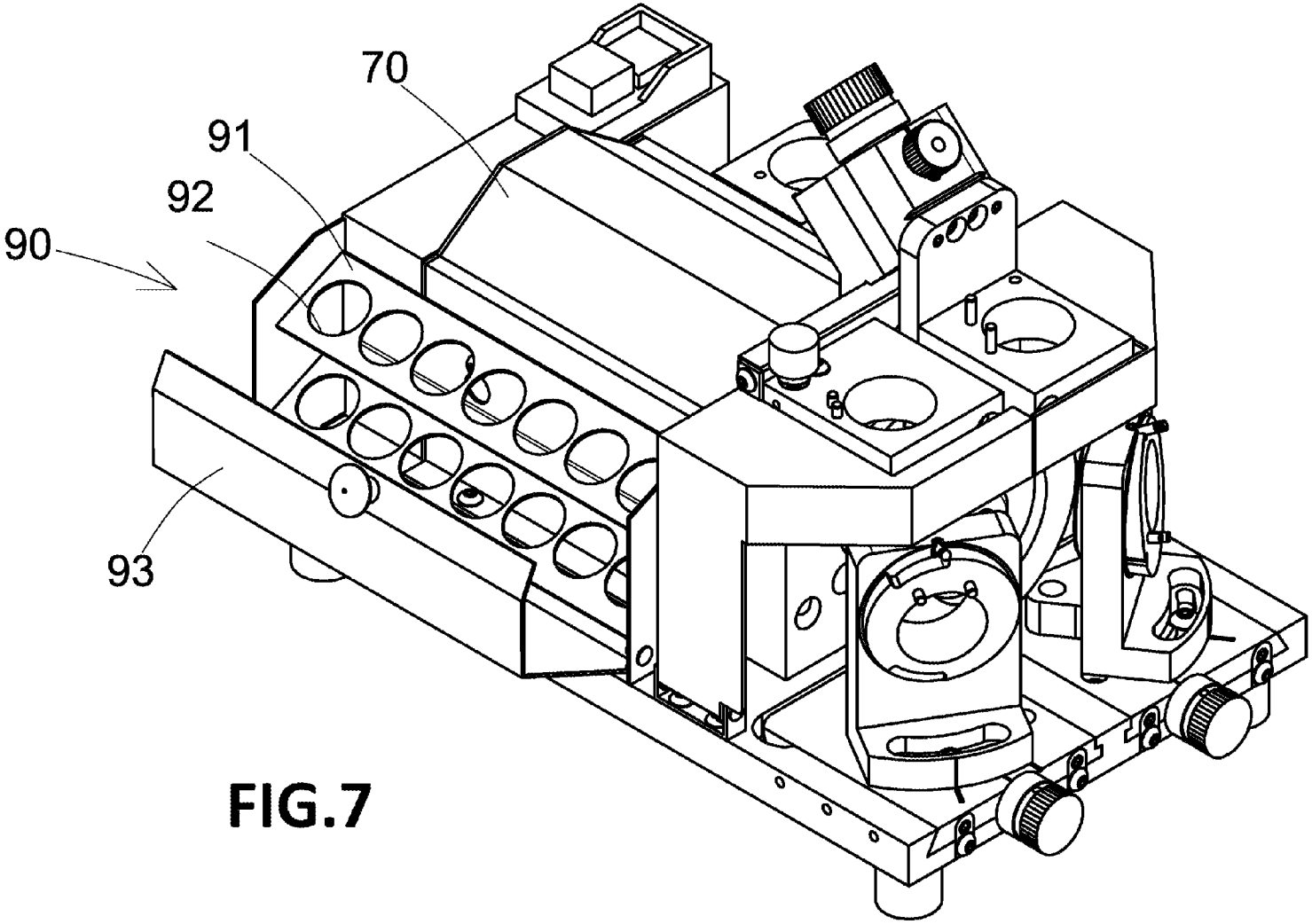
FIG. 7 is a view similar to FIG. 6 showing the holding device being open.
Figure 8:
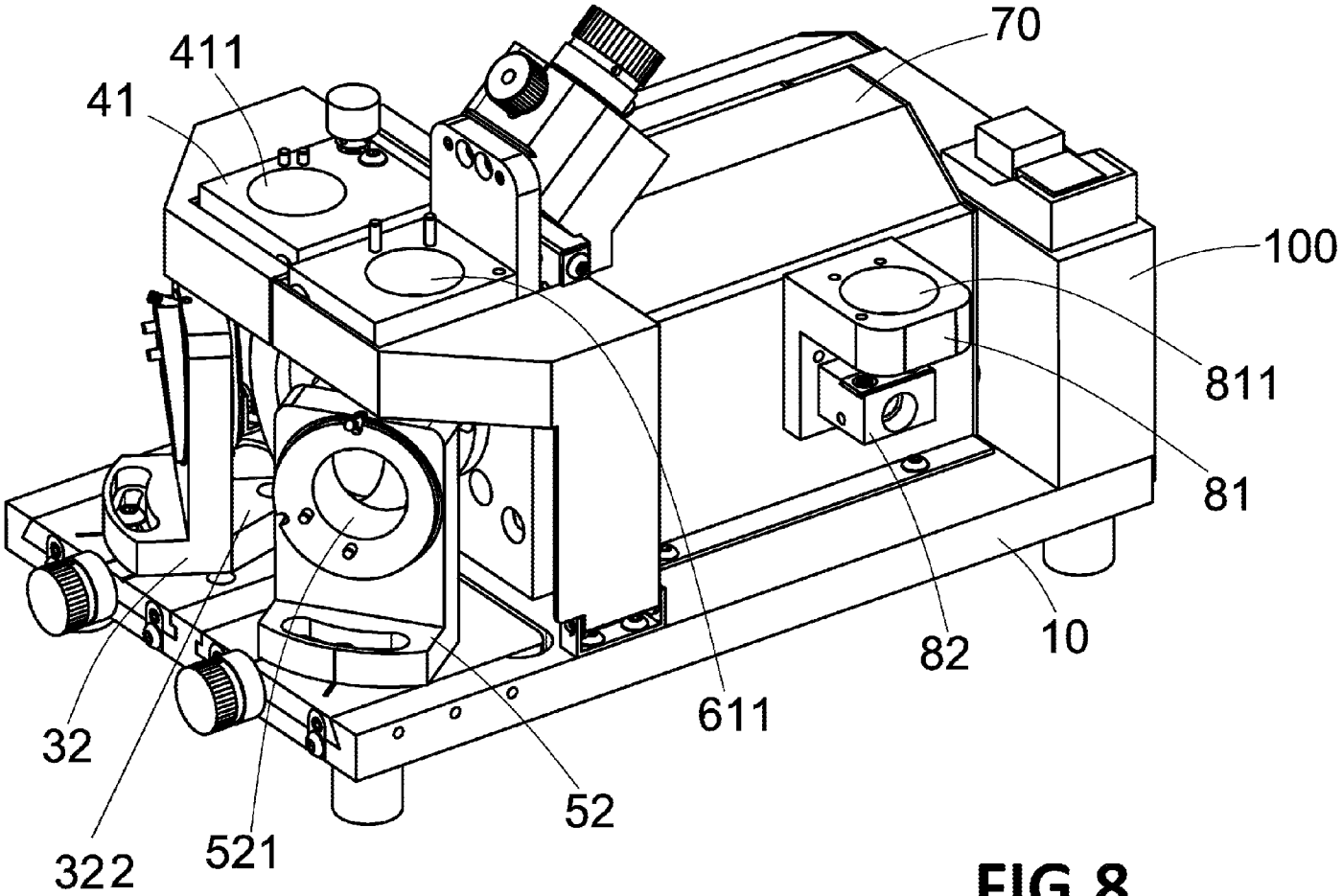
FIG. 8 is another perspective view of the grinding machine of FIG. 6.
Figure 9:
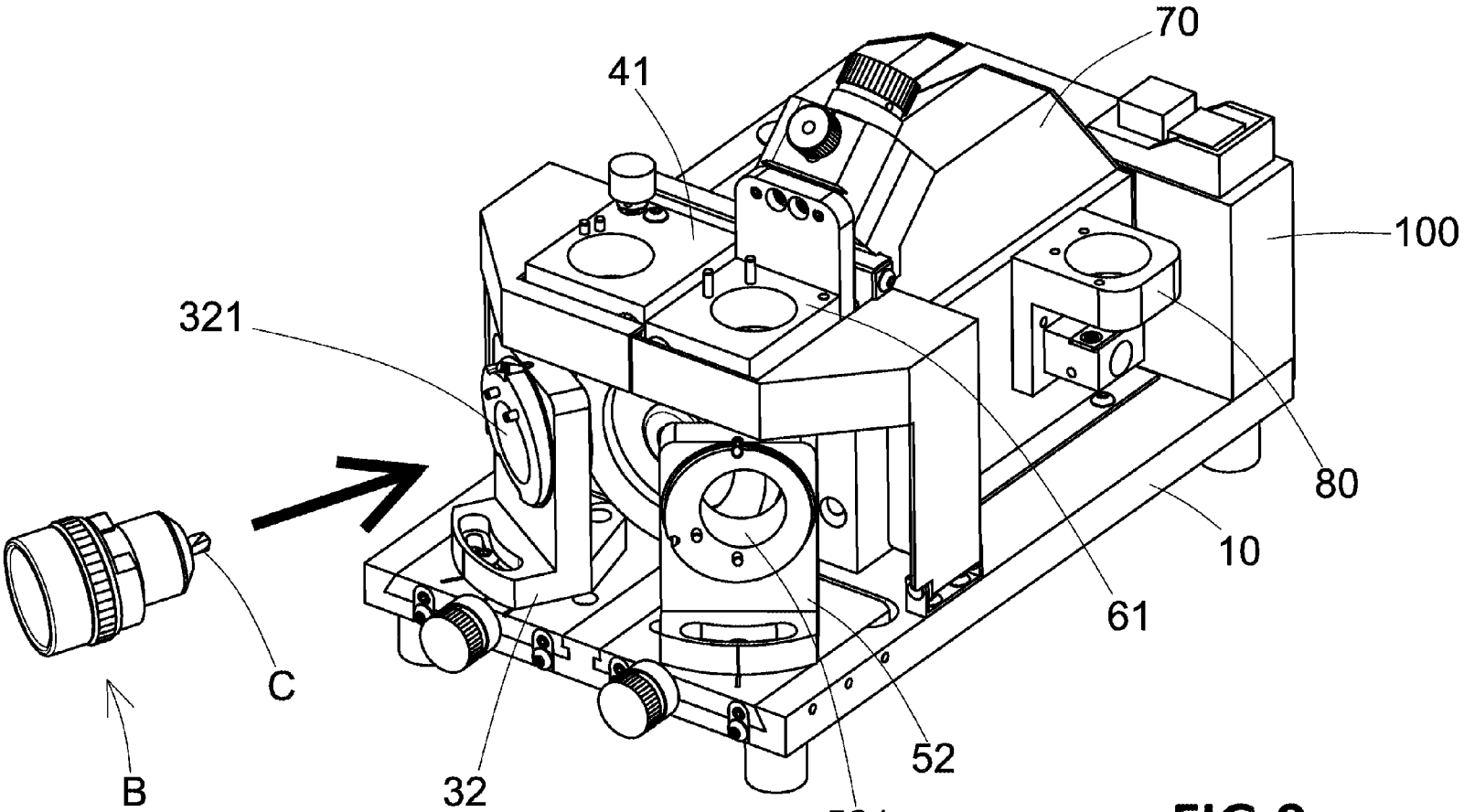
FIG. 9 is a perspective view showing a cutting tool held by a chuck to be inserted into the transverse channel in a grinding operation.

Referring to FIGS. 1 to 9, a grinding machine in accordance with the invention comprises the following components as discussed in detail below.

A rectangular base 10 includes a wall 11 on a top, the wall 11 having a central through hole 111 and an upper shoulder 112. A plurality of fasteners A each having a threaded portion A1 are used to secure the base 10 to the wall 11. An electric motor 20 includes an abrasive wheel 22, a mounting member 23 secured to the through hole 111, and a drive shaft 21 passing through the mounting member 23 to secure to the abrasive wheel 22.

A first workpiece holding unit 30 includes a board 31 secured to the base 10 and having an adjustment knob 311, an L-shaped seat 32 secured to the board 31 and having a transverse channel 321 through a vertical part, a front curved slot 323 through a horizontal part, a rear projection 322 on the horizontal part, a pivot 324 driven through the projection 322 and the board 31 to pivotably secure the seat 32 and the board 31 together, and a pin 325 secured to the board 31 and disposed in the slot 323. The seat 32 can pivot about the pivot 324 so that the pin 325 may be located at one end of the slot 323, at the other end of the slot 323, or any position between two ends of the slot 323.

A third workpiece holding unit 50 includes a board 51 secured to the base 10 and having an adjustment knob 511, an L-shaped seat 52 secured to the board 51 and having a transverse channel 521 through a vertical part, a front curved slot 523 through a horizontal part, a rear projection 522 on the horizontal part, a pivot 524 driven through the projection 522 and the board 51 to pivotably secure the seat 52 and the board 51 together, and a pin 525 secured to the board 51 and disposed in the slot 523. The seat 52 can pivot about the pivot 524 so that the pin 525 may be located at one end of the slot 523, at the other end of the slot 523, or any position between two ends of the slot 523.

A second workpiece holding unit 40 is secured to the shoulder 112 and includes a body 41 having a vertical tunnel 411. A fourth workpiece holding unit 60 includes a body 61 having a vertical tunnel 611, an adjustment knob 62, and a fastening member 63. A plurality of fasteners A each having a threaded portion A1 are used to secure the fourth workpiece holding unit 60 to the shoulder 112. A cover 70 is placed on the motor 20 and secured to the base 10. A positioning device 80 includes an inverted L-shaped support 81 having a vertical channel 811, and a seat 82 secured to one side of the cover 80. A holding device 90 secured to the other side of the cover 80 and includes two shelves 91, a plurality of holes 92 through the shelves 91, and a hinged cover 93. A power source 100 is provided on the base 10 behind the motor 20. The power source 100 is electrically connected to the motor 20 for supplying power thereto.

The drive shaft 21 rotates after activating the motor 20. And in turn, the abrasive wheel 22 rotates. A cutting tool C is held by a chuck B. Further, the chuck B is inserted into the channel 321 and fastened therein. Thus, the abrasive wheel 22 can grind the cutting tool C.

While the invention has been described in terms of preferred embodiments, those skilled in the art will recognize that the invention can be practiced with modifications within the spirit and scope of the appended claims.

What is claimed is:

1. A grinding machine comprising:

an abrasive wheel;

a rectangular base including a wall fastened on a top, the wall having a central through hole and an upper shoulder;

a mounting member secured to the central through hole;

an electric motor including a drive shaft passing through the mounting member to secure to the abrasive wheel;

first and third workpiece holding units each including a board secured to the base; an adjustment knob disposed on the board; and an L-shaped seat secured to the board and having a transverse channel, a front curved slot, a rear projection pivotably secured to the board, and a pin secured to the board and disposed in the slot;

a second workpiece holding unit secured to the shoulder and including a vertical tunnel;

a fourth workpiece holding unit secured to the shoulder and including a vertical tunnel, an adjustment knob, and a fastening member;

a cover placed on the electric motor and secured to the base;

a positioning device including a vertical channel and a seat secured to one side of the cover;

a holding device secured to the other side of the cover and including at least one shelf, a plurality of holes through the at least one shelf, and a hinged cover; and a power source disposed on the base adjacent to the electric motor, the power source being electrically connected to the electric motor.

* * * * *